US009708153B2

(12) United States Patent
Kim et al.

(10) Patent No.: US 9,708,153 B2
(45) Date of Patent: Jul. 18, 2017

(54) EASILY REMOVABLE PAPER TUBE, ARTICLE USING THE PAPER TUBE, AND METHOD FOR SUCCESSIVELY USING THE ARTICLES

(71) Applicant: TORAY ADVANCED MATERIALS KOREA INC., Gyeongsangbuk-do (KR)

(72) Inventors: Gwang-Su Kim, Daegu (KR); Seung-Hun Lee, Daegu (KR); Hwang-Yong Kim, Gyeongsangbuk-do (KR); Sang-Pil Kim, Gyeongsangbuk-do (KR)

(73) Assignee: TORAY ADVANCED MATERIALS KOREA INC., Gyeongsangbuk-Do (KR)

( * ) Notice: Subject to any disclaimer, the term of this patent is extended or adjusted under 35 U.S.C. 154(b) by 80 days.

(21) Appl. No.: 14/650,384

(22) PCT Filed: Oct. 22, 2014

(86) PCT No.: PCT/KR2014/009945
§ 371 (c)(1),
(2) Date: Jun. 8, 2015

(87) PCT Pub. No.: WO2015/068972
PCT Pub. Date: May 14, 2015

(65) Prior Publication Data

US 2016/0167917 A1 Jun. 16, 2016

(30) Foreign Application Priority Data

Nov. 6, 2013 (KR) ..... 10-2013-0134418

(51) Int. Cl.
*B65H 75/10* (2006.01)
*B65H 16/00* (2006.01)
*B65H 49/12* (2006.01)

(52) U.S. Cl.
CPC ..... *B65H 75/10* (2013.01); *B65H 16/00* (2013.01); *B65H 49/12* (2013.01); *B65H 2701/5112* (2013.01); *B65H 2701/532* (2013.01)

(58) Field of Classification Search
CPC ..... B65H 75/10; B65H 49/12; B65H 16/00
See application file for complete search history.

(56) References Cited

U.S. PATENT DOCUMENTS 6,467,749 B1 10/2002 van de Camp ..... 249/48
2007/0059467 A1* 3/2007 van de Camp ..... B31C 3/00 428/36.3

FOREIGN PATENT DOCUMENTS

CN 202481856 10/2012 ..... A47K 10/22
CN 102785975 11/2012 ..... B65H 75/18
(Continued)

OTHER PUBLICATIONS

Japanese Office Action for JP 2015-546408 issued on Apr. 13, 2016.
(Continued)

*Primary Examiner* — Sang Kim
(74) *Attorney, Agent, or Firm* — Harness, Dickey & Pierce, P.L.C.

(57) ABSTRACT

The present invention relates to an easily removable paper tube used for winding material, such as fabric, a band, a film, and so forth, and a method for successively using articles, each of which uses the paper tube, and, more specifically, to an easily removable paper tube and a method for successively using articles that use the paper tube, in which the paper tube is effectively removed, without deforming a roll of material wound around the paper tube, such use of the
(Continued)

material enabled by releasing it from the inside of the roll with the paper tube removed, thereby increasing the unrolling speed of the material, and a first article and a second article, each of which includes wound material, are connected to each other for use, thereby allowing successive provision of the articles, and thus remarkably increasing a rate of successive production.

14 Claims, 12 Drawing Sheets

(56) References Cited

FOREIGN PATENT DOCUMENTS

| | | | |
|---|---|---|---|
| EP | 0728692 | 2/2002 | B65H 19/18 |
| EP | 2055471 | 5/2009 | B31C 3/00 |
| FR | 2539104 | 7/1984 | B31C 3/00 |
| FR | 2560585 | 9/1985 | B31C 11/00 |
| GB | 1170782 | 11/1969 | |
| JP | 10-212070 | 8/1998 | B65H 55/04 |
| JP | 10-236735 | 9/1998 | B65H 75/10 |
| JP | 2000-272031 | 10/2000 | B31C 3/00 |
| JP | 2001-163529 | 6/2001 | B65H 75/50 |
| JP | 2010-126360 | 6/2010 | B65H 75/50 |
| KR | 10-1998-0008536 | 4/1998 | B31C 1/00 |
| KR | 20-0269369 | 3/2002 | A01G 13/02 |
| KR | 10-1277248 | 6/2013 | B65H 75/02 |
| RU | 2186009 | 7/2002 | B65H 19/18 |
| RU | 2372270 | 11/2009 | B65H 19/18 |
| WO | WO 2005/051817 | 6/2005 | B65H 19/18 |

OTHER PUBLICATIONS

Office Action issued Jul. 15, 2016 in Russian counterpart application of U.S. Appl. No. 14/650,384.

International Search Report in PCT/KR2014/009945 mailing date Jan. 23, 2015, with English Translation.

* cited by examiner

EASILY REMOVABLE PAPER TUBE, ARTICLE USING THE PAPER TUBE, AND METHOD FOR SUCCESSIVELY USING THE ARTICLES

CROSS-REFERENCE TO RELATED APPLICATIONS

This application is a national phase application of PCT Application No. PCT/KR2014/009945, filed on 22 Oct. 2014, which claims benefit of Korean Patent Application 10-2013-0134418, filed on 6 Nov. 2013. The entire disclosure of the application identified in this paragraph is incorporated herein by reference.

FIELD

The present invention relates to an easily removable paper tube used for winding material, such as fabric, a band, a film and so forth, and a method for successively using articles, each of which uses the paper tube, and, more specifically, to an easily removable paper tube and a method for successively using articles that use the paper tube, in which the paper tube is effectively removed, without deforming a roll of material wound around the paper tube, such use of the material enabled by releasing it from the inside of the roll with the paper tube removed, thereby increasing the unrolling speed of the material, and a first article and a second article, each of which includes wound material, are connected to each other for use, thereby allowing successive provision of the articles and thus remarkably increasing a rate of successive production.

BACKGROUND

In general, a paper tube is formed in a cylindrical shape by cutting a sheet of source paper in a predefined length, and gluing and continuously rolling up the cut source paper in a spiral fashion in several layers.

Material, such as thread, cord, fabric, film, and the like, which is wound around the paper tube is generally unwound from the outer layers of a roll by rotating the paper tube, but in this case, it is difficult to unroll the material at high speed, and after one article of wound material is completely used, another article needs to be connected to the used article, that is, the articles should be separately used one by one, thereby a rate of successive production is degraded.

Technical Problem

The present invention is devised to solve the aforementioned problems, and one purpose of the present invention is to provide an easily removable paper tube and a method for successively using articles with the paper tube, in which successive perforations are helically formed along a lengthwise direction of the paper tube, that is, the length direction of a winding surface around which material is wound, so that the paper tube can be effectively removed while maintaining the winding state of the material, without deforming a roll of material, thereby enabling the material to be released from the inside after the removal of paper tube, and thus improving the unrolling speed of the material, and in which a first article of wound material and a second article of wound material are used by connecting them to each other, thereby making it possible to successively provide the articles, and thus to remarkably improve a rate of successive production.

The above and another purposes and advantages of the present invention will be more apparent from the following description of exemplary embodiments.

Technical Solution

The above purpose is achieved by an easily removable paper tube according to a first aspect, which is characterized by including a perforated portion that has perforations helically formed on a winding surface of the paper tube with a cylindrical shape.

Here, a length ratio of a perforation of the perforated portion to a non-perforated part (i.e., a length between two perforations) may be 0.5:1 to 10:1.

Preferably, an angle of the perforated portion relative to a horizontal plane may be 20 degrees to 40 degrees.

Preferably, a distance between two perforated portions may be 30 mm to 200 mm.

According to a second aspect, an easily removable paper tube may further include at least one additional sheet of source paper wrapped around a winding surface thereof, except the perforated portion.

According to a third aspect, the easily removable paper tube may further include at least one sheet of film or paper that wraps around an outermost circumferential surface of the paper tube of the second aspect.

Preferably, a central line surface roughness of the film or paper may be 0.03 μm to 10 μm.

Preferably, the length of the film or paper may be shorter than a length of the paper tube, but longer than a length of the wound material.

Preferably, the film or paper may be thermally contracted.

According to a fourth aspect, the easily removable paper tube may further include at least one sheet of film or paper that surrounds an outermost circumferential surface of the paper tube of the first aspect.

The above purpose can be achieved by a method of successively using articles using a paper tube, the method comprising four steps: removing the easily removable paper tube of the fourth aspect from each of at least two articles, each of which comprises the material wound around the paper tube; removing the film or paper from the each of at least two articles; forming an outer tail after removing an outer knot of the wound material from the each of at least two articles; and forming a connection portion between the at least two articles by tying the outer tail of one of the at least two articles to an inner tail of the other article.

Preferably, the method may be applicable to at least two articles, each of which includes material wound around the easily removable paper tube of the third aspect.

In addition, the above object is achieved by an article using the aforementioned easily removable paper tube, the article including the paper tube and material wound around the paper tube.

The wound material may be one of fiber, non-woven fabric, film, or fabric.

Additional features of the invention will be set forth in the description which follows, and in part will be apparent from the description, or may be learned by practice of the invention.

Advantageous Effects

According to the present invention, a paper tube can be easily removed, thereby increasing the work efficiency or production efficiency, and after removing the paper tube, wound material can be used from the inside, so that it is possible to connect a first article and a second article by connecting an external end or the internal end of the first article to an internal end or an external end of the second article, which allows the successive production of the articles, thereby significantly contributing to productivity improvement.

DRAWINGS

Figure 1:
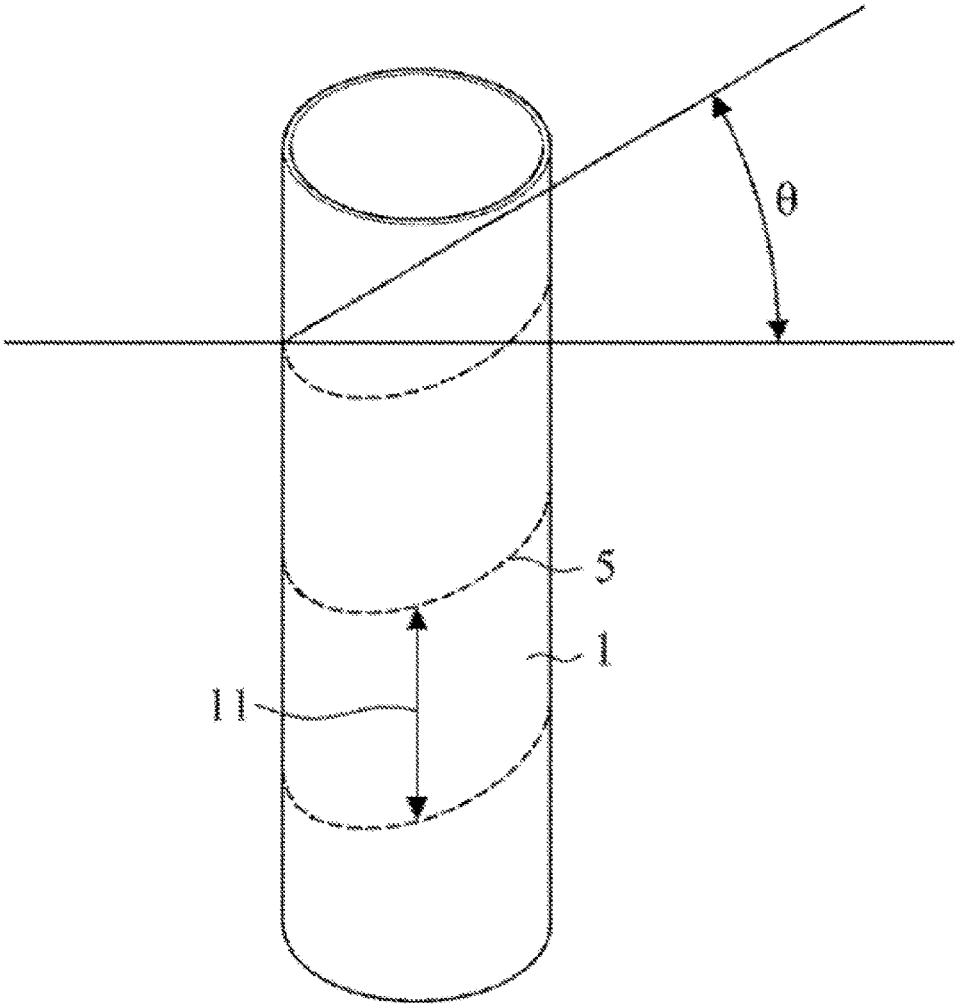
FIG. 1 is a perspective view of an easily removable paper tube according to an exemplary embodiment.

| Reference numerals as shown in drawings denote the following: | |
|---|---|
| 1: Paper tube | 2: Wound material |
| 3: Source paper | 4: Film or paper |
| 5: Perforated portion | 6: Perforation |
| 7: Non-perforated part | 8: Saw teeth |
| 9: Outer tail | 10: Inner tail |
| 11: Source paper width | 12: Mandrel |
| 13: Belt | 14: Cutter |
| 15: Adhesive | 16: Connection portion |

BEST MODE

An easily removable paper tube includes a perforated portion that is formed by helically perforating a winding surface of the paper tube with a cylindrical shape.

MODE FOR INVENTION

The invention is described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

Unless otherwise defined, all technical and scientific terms used herein have the same meaning as commonly understood by one of ordinary skill in the art to which this invention belongs. In case of conflict, the specification, including definitions, will control.

Although methods and materials similar or equivalent to those described herein can be used in the practice or testing of the invention, suitable methods and materials are described herein.

Unless stated otherwise, all percentages, parts, ratios, etc., are by weight. When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the end-points thereof, and all integers and fractions within the range. It is not intended that the scope of the invention be limited to the specific values recited when defining a range.

When the term "about" is used in describing a value or an end-point of a range, the disclosure should be understood to include the specific value or end-point referred to.

As used herein, the terms "comprises," "comprising," "includes," "including," "containing," "characterized by," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Where applicants have defined an invention or a portion thereof with an open-ended term such as "comprising," it should be readily understood that unless otherwise stated the description should be interpreted to also describe such an invention using the terms "consisting essentially of and "consisting of.

Referring to FIG. 1 which is a perspective view of a easily removable paper tube according to an exemplary embodiment, the easily removable paper tube 1 with a cylindrical shape in accordance with a first aspect of the present invention is characterized by having a perforated portion 5 produced by helically perforating a winding surface of the cylindrical paper tube 1. Accordingly, the paper tube with material wound around it can be easily removed along the perforated portion, and the material can be easily unwound from inside when the paper tube has been removed (refer to FIG. 2).

Figure 5:
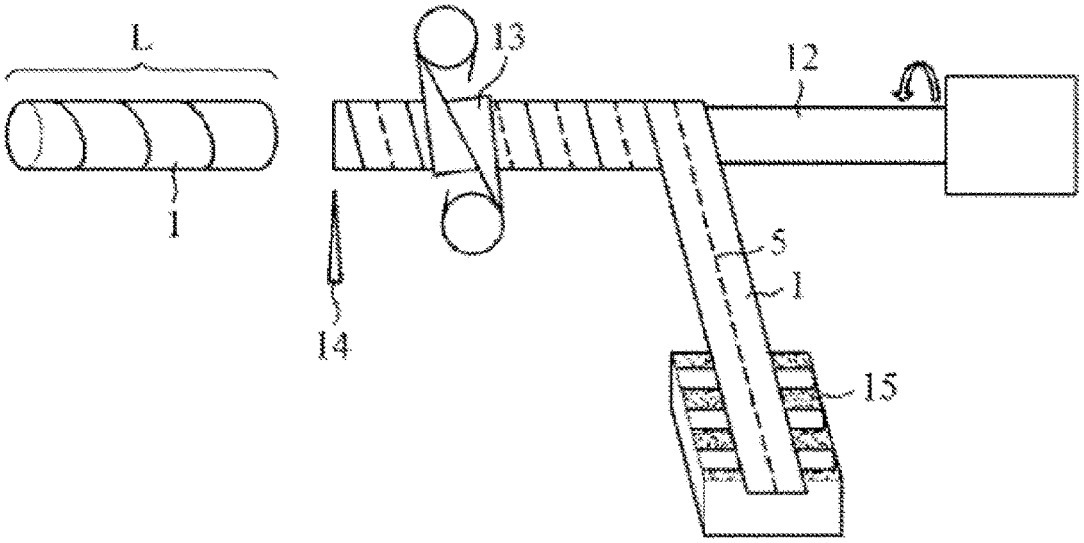
FIG. 5 is a diagram illustrating a method for manufacturing an easily removable paper tube according to an exemplary embodiment.
Figure 6:
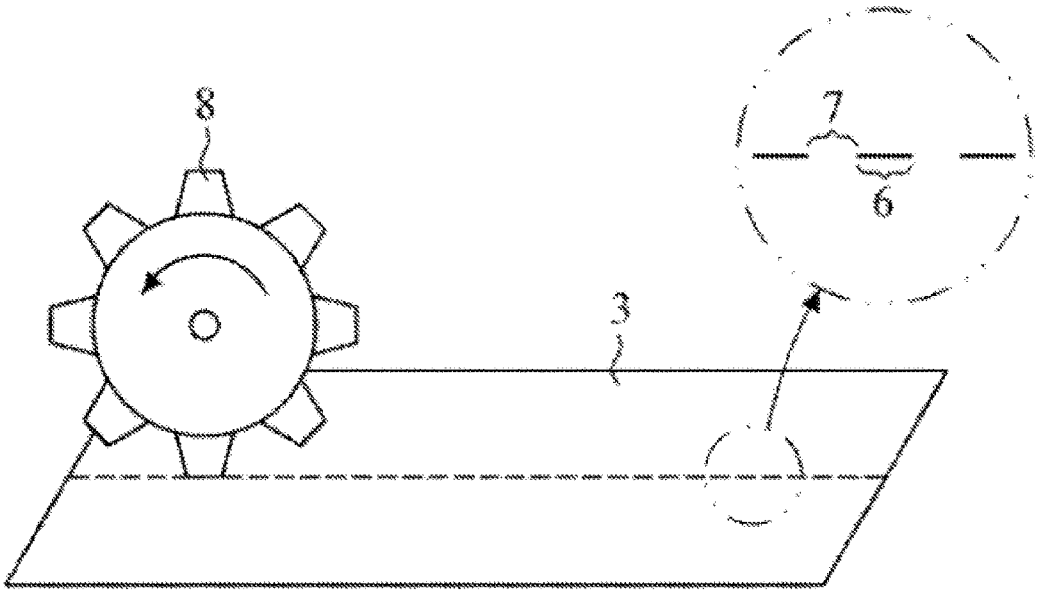
FIG. 6 is a diagram illustrating a method for forming a perforated portion on a source paper used for the easily removable paper tube according to the exemplary embodiment.

According to an exemplary embodiment, perforation process is performed on source paper 3 before being rolled up to form the paper tube (refer to FIG. 5 and FIG. 6). In this case, the thickness and/or the number of layers of the source paper may be determined according to the material to be wound around the paper tube, and may be adjusted according to the work efficiency in the removal of the paper tube. As the thickness of the source paper is increased, the compression strength is also increased, which may be advantageous in controlling the weight of the material to be wound or a surface pressure when winding the material around the paper tube, whereas the thicker source paper may cause a degradation of work efficiency since it requires a substantial amount of effort when removing the paper tube.

The perforated portion 5 may be formed by punching holes in the middle of the source paper 3 using a device with saw teeth, as shown in FIG. 6 that illustrates a method for forming the perforated portion on the source paper that is used for the easily removable paper tube according to an exemplary embodiment. In perforation process, a length ratio of a perforation 6 of the perforated portion 5 to a non-perforated part 7, that is, a length 7 between two perforations 6 of the perforated portion 5 may be preferably 0.5:1 to 10:1. When the length ratio of a perforation 6 to a non-perforated part 7 between two perforations 6 is less than 0.5:1, the total area of the perforations is so small that a great amount of power is required to remove the paper tube, and the paper tube may be torn off without being completely removed. When the length ratio of a perforation to a non-perforated part between two perforations is greater than 10:1, the total area of the perforations is so large that the paper tube becomes difficult to handle and easy to be torn even at low compression. Therefore, appropriate condition setting is required, according to properties of material to be wound and/or the work efficiency.

In perforation process, the source paper after perforations are formed thereon is wound up at a predetermined angle θ (refer to FIG. 1) to an axial direction to form the paper tube. At this time, the angle θ at which the source paper is wound, that is, the angle of the perforated portion may be determined according to circumstances, as this angle relates to the power required to remove a paper tube, work efficiency, and the like. The angle θ of the perforated portion 5 relative to a horizontal plane may range between 20 degrees to 40 degrees, which may be advantageous in terms of power and work efficiency at the time of removing the paper tube. An angle of less than 20 degrees results in a greater area of the perforated portion, which causes increase in time required for removal of the paper tube, and thus decreases the work efficiency, and an angle of greater than 40 degrees does not ensure the stable removal of the paper tube, and may cause the paper tube to be torn during removal.

In addition, in perforation process, a length between perforated lines of the paper tube is determined by the width (a distance between perforated portions appearing on the paper tube) of source paper 11 to be perforated. The width of the source paper (a distance between the perforated portions) is preferably 30 mm or greater, and up to 200 mm. If the source paper width is greater than 200 mm, the area of the perforated portion to be removed is reduced and thus the strength required for removal is lowered, but the stable removal of the perforated portion may not be ensured and the paper tube may be torn during the removal. If the width of the source paper is less than 30 mm, the entire area of the perforated portion increases, resulting in increase of time needed to remove a paper tube and degradation of work efficiency.

Figure 3:
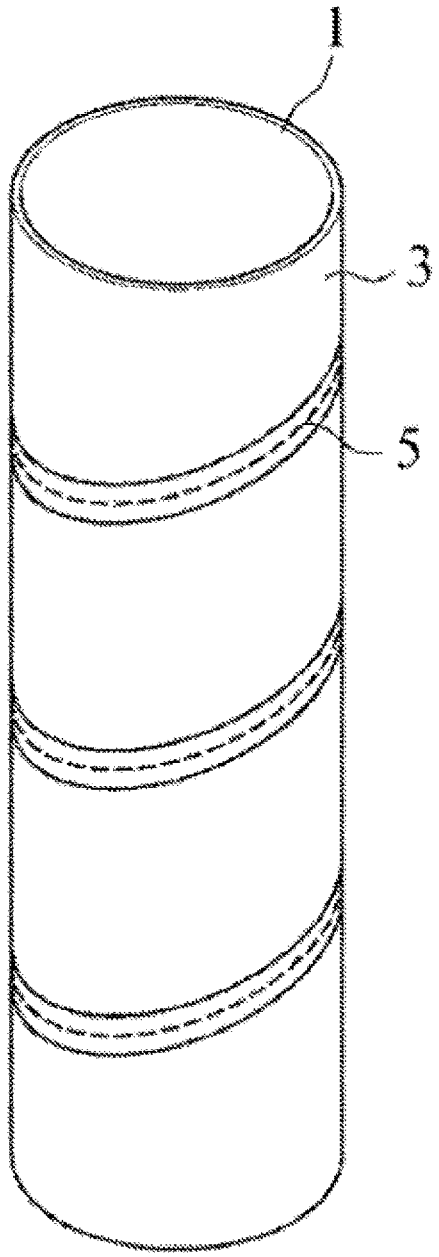
FIG. 3 is a perspective view of an easily removable paper tube according to another exemplary embodiment.

In the paper tube 1 with the perforated portion, in a case where the paper tube is formed only with the source paper with the perforated portion, a thinner sheet of source paper may cause lowering of the compression strength, leading to deterioration of the handling of the paper tube, and thus the paper tube may be easily damaged during operation. Whereas, a thicker sheet of source paper may require more power to remove the paper tube and cause the paper tube to be torn during the removal. Therefore, a single sheet of source paper of an appropriate thickness on which perforation process was performed to have one or more sheets of secondary source paper wrapped around a remaining area other than the perforated portion, so that high efficiency in removing the paper tube can be maintained and the thickness of the remaining area can be enhanced, thereby reinforcing the paper tube such that better handling of the paper tube and excellent resistance to a winding surface pressure can be provided. Thus, as shown in FIG. 3 that is a perspective view of a paper tube according to another exemplary embodiment of the present invention, an easily removable paper tube according to a second aspect of the present invention may be characterized by further having at least one sheet of source paper 3 that is wound around an area of the winding surface of the paper tube, other than the perforated portion 5.

Figure 4:
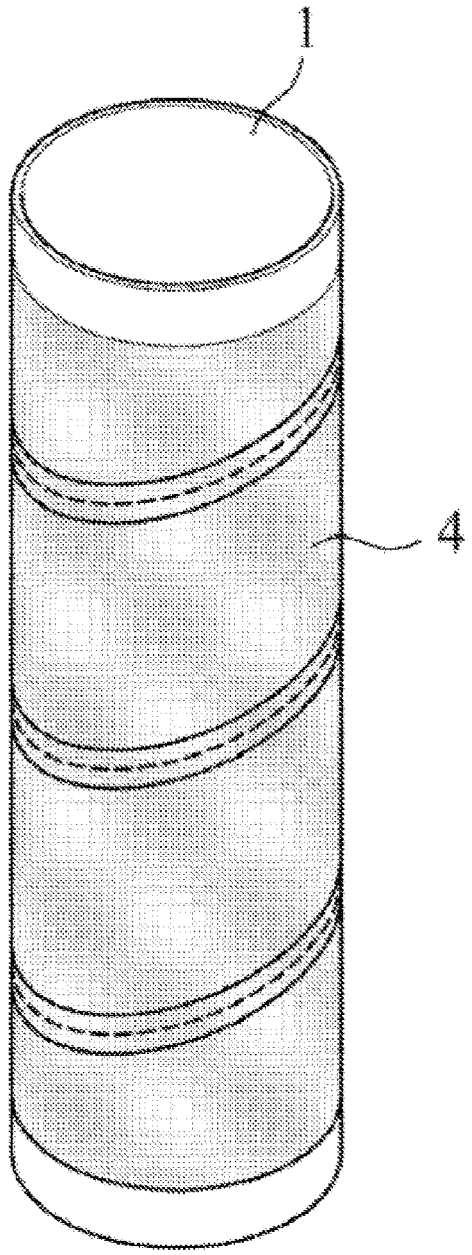
FIG. 4 is a perspective view of an easily removable paper tube according to another exemplary embodiment.

In the above paper tube, in a case where material is wound around and in direct contact with the paper tube, it may be highly likely for an internal part of the material to be damaged by the torn part or damaged part of the paper tube in the process of removing the paper tube by splitting and pulling the paper tube. Therefore, to overcome such problems, it may be preferable to wrap film or paper around an outermost circumferential surface of the paper tube formed by the above method to prevent the internal part of the wound material from being damaged and deformed when primarily removing the source, and then remove the additional film or paper. Thus, as shown in FIG. 4, in a perspective view of an easily removable paper tube according to another exemplary embodiment, an easily removable paper tube according to a third aspect of the present invention is characterized by further having at least one sheet of film or paper 4 to wrap the outermost circumferential surface of the paper tube 1 of the second aspect.

The easily removable paper tube according to a fourth aspect of the present invention is characterized by having at least one sheet of film or paper 4 that wraps around the outermost circumferential surface of the paper tube 1 of the first aspect of the invention. That is, the paper tube 1 includes at least one sheet of film or paper 4 that surrounds the outermost circumferential surface of the winding surface of the paper tube 1 that does not include at least one sheet of source paper 3 wound around the entire surface of the source paper, other than the perforated portion 5.

In this case, the film or paper 4 processed to wrap the outermost circumferential surface may have a central line surface roughness Ra of preferably 0.03 μm to 10 μm. The surface roughness Ra of less than 0.03 μm may cause the surface to be so smooth that it may become difficult to wind the material around the paper tube, and whereas the surface roughness Ra of greater than 10 μm may cause the wound material to be damaged by the surface of the film or paper.

In addition, in wrapping the outermost circumferential surface of the paper tube with the film or paper 4, the length of the film or paper may be set to be shorter than the entire length of the paper tube, but longer than the length (a distance between both ends) of the material to be wound, so that improved work efficiency can be provided when the paper tube is initially torn.

Moreover, it may be preferable to primarily wrap the surface of the paper tube with the film or paper 4, and then secondarily heat the surface to thermally contract. The film or paper 4 is in contact with the paper tube by the contraction force of the film or paper 4, and thus the film or paper 4 can be prevented from being torn, which may be caused by adhesion to the surface of the paper tube.

Further, a method for successively using articles, each of which utilizes the paper tube according to an exemplary embodiment, may include four steps: removing the paper tube 1 of the third aspect of the present invention from each of at least two articles, each of which includes the material 2 wound around the paper tube 1; removing the film or paper 4 from the each of at least two articles, forming an outer tail 10 after removing an outer knot of the material 2 of the each of at least two articles; and forming a connection portion 16 by connecting the outer tail 10 of one article with an inner tail 9 of another article.

Figure 8:
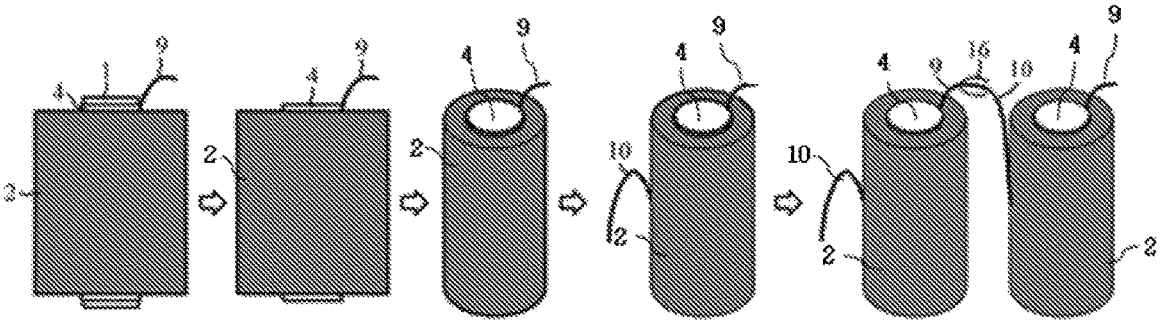
FIG. 8 is a diagram illustrating a method for using an easily removable paper tube according to a third aspect.

A method of successively using articles, each of which uses a paper tube will be described in detail with reference to FIG. 8 that illustrates a method of successively using fabric (article) that is the wound material 2 after removing the paper tube of the third aspect of the present invention.

Figure 2:
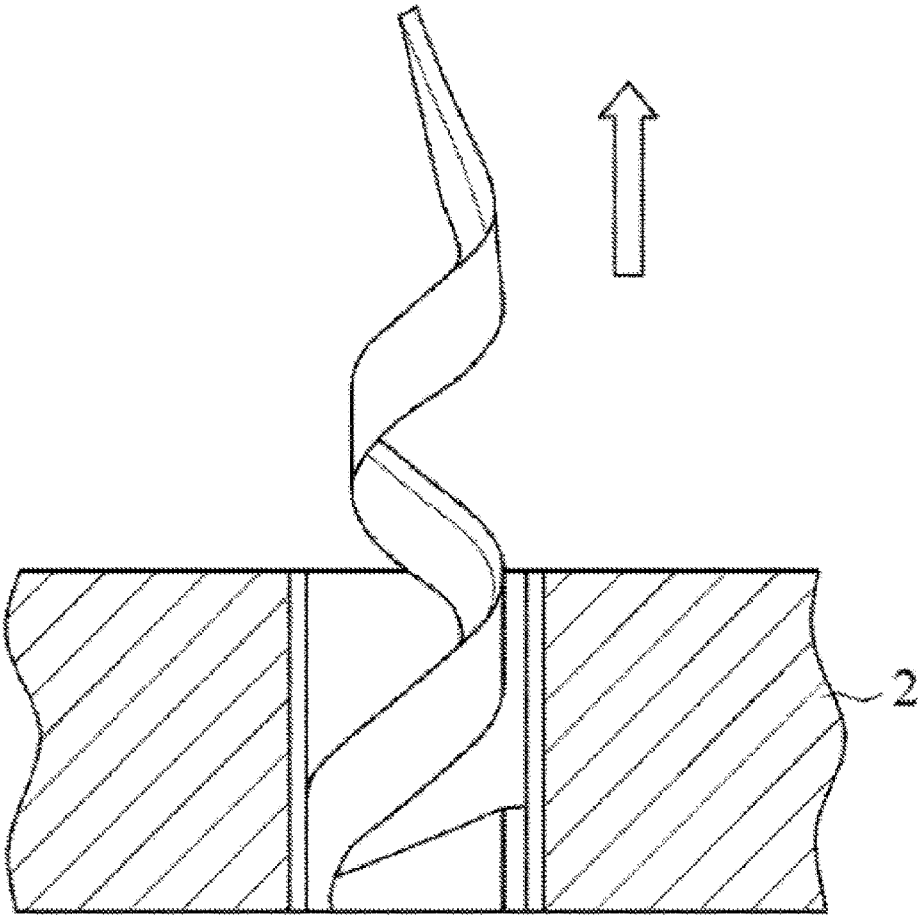
FIG. 2 is a diagram showing process of removing a paper tube from wound material.

First, in a first step, the paper tube 1 is removed from each of at least two articles, each of which includes the material 2 wound around the paper tube of the third aspect, wherein the paper tube can be easily removed along the perforated portion according to the technical features of the present invention, so that the material 2 can be easily unrolled from the inside, with the paper tube removed (refer to FIG. 2).

In a second step, the film or paper 4 is further removed from the article, wherein the film or paper 4 on an outer surface of the paper tube has prevented the inside of a roll of wound material from being damaged or deformed when the paper tube was primarily removed.

In a third step, an outer tail 10 of the article, that is, a tail for connection with wound material of another article, is formed after removing the outer knot of the roll of wound material from which the film or paper 4 has been removed in the second step.

In a fourth step, the connection portion 16 is formed by connecting the outer tail 10 of the article that is formed in the third step with an inner tail 9 of another article, wherein two or more articles can be connected to each other in the same manner, in which an outer side or an inner side of a first article can be connected to an inner side or an outer side of a second article, so that it is feasible to successively provide two or more articles, thereby significantly contributing to the productivity improvement.

It may be appreciated by one of ordinary skill in the art that the purpose of the present invention can be achieved even when the paper tube of the fourth aspect is employed in the method for successively using the articles utilizing the paper tube.

An article utilizing an easily removable paper tube according to the present invention is characterized by including the easily removable paper tube and material wound around the paper tube. It is obvious that any types of articles for sale that has material wound around such a paper tube will be within the scope of the present invention.

The material may be one of, but not limited to, for example, fiber, non-woven fabric, film, or fabric.

Hereinafter, the configuration and effects of the present invention will be described in detail with reference to examples and comparative examples thereof. However, the examples are provided only for the purpose of detailed description, and thus the scope of the invention is not limited thereto.

Examples 1 to 5

After perforation process on a sheet of source paper of 75 mm in width using saw teeth as shown in FIG. 6, a paper tube of 280 mm in length was manufactured as shown in FIG. 1 through procedures schematically shown in FIG. 5. In this case, an angle θ of a perforated portion relative to a horizontal plane was set to 28°. In examples 1 to 5, a length ratio of a perforation of the perforated portion to a non-perforated part between two perforations was set to, respectively, 0.5:1, 1:1, 2:1, 5:1, and 10:1 in the perforation process.

Examples 6 to 8

The paper tube was manufactured in the same manner as in Example 3 except that a sheet of source paper of 50 mm, 75 mm, and 100 mm in width was used in the respective examples 6 to 8, while a length ratio of a perforation to a non-perforated part between two perforations was fixed to 2:1 in the perforation process.

Example 9

The paper tube was manufactured in the same manner as in Example 3 except that the entire area of the paper tube, other than the perforated portion, was wrapped with secondary source paper as shown in FIG. 3 while a length ratio of a perforation to a non-perforated part between two perforations was fixed to 2:1.

Example 10

The paper tube was manufactured with the same method as used in Example 9, and then was processed by having a film wrapped around an outer circumferential surface as shown in FIG. 4. At this time, a surface of the paper tube was primarily wrapped with a shrinkable PET film of 40 μm in thickness with a surface roughness of 0.05 μm, and then secondarily heated to contract. The contraction force of the film enabled the film to maintain contact with the paper tube, so that when the paper tube is removed, the film could be prevented from being torn which may be caused by adhesion to the surface of the paper tube.

Figure 7:
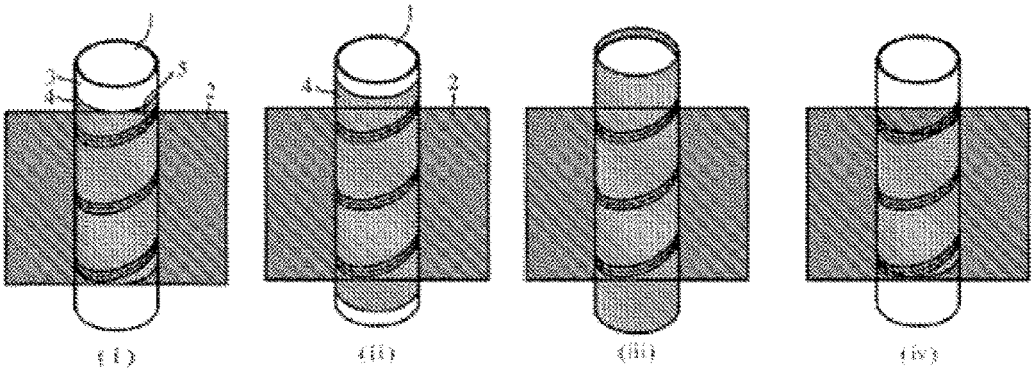
FIG. 7 is a diagram illustrating examples of the easily removable paper tube which are manufactured to have different lengths of film.

In this case, as shown in FIG. 7 (*ii*), a PET film with a length that is shorter than the length of the paper tube and longer than the length of material to be wound around the paper tube was used in Example 10, and an actual material (fiber) was wound around the paper tube around which the film was wrapped.

Comparative Examples 1 to 3

The paper tube was manufactured with the same method as used in example 10. However, in Comparative Example 1, the length of the PET film was the same as the length of the material wound around the paper tube, as shown in FIG. 7 (*i*), in Comparative Example 2, the length of the PET film was longer than the length of the paper tube as shown in FIG. 7 (*iii*), and in Comparative Example 3, the length of the PET film was shorter than the length of the material wound around the paper tube as shown in FIG. 7(*iv*), and then actual material (fiber) was wrapped around the paper tube of each Comparative Example.

Evaluations as below were carried out on the paper tube of Examples 1 to 10 and Comparative Examples 1 to 3 and the results are shown in tables further below.

[Evaluation Method]

1. Split Strength Evaluation (Peel TEST)

Figure 9:
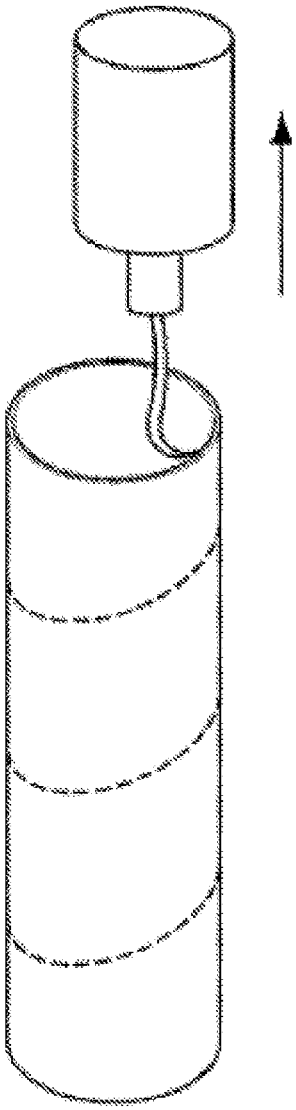
FIG. 9 is a diagram showing an example of the measurement process of a split strength using a PEEL tester.

The split strength of the paper tube with a perforated portion formed thereon was measured using a peel tester as shown in FIG. 9 by hooking one end of the paper tube and pulling it upward.

2. Compressive Strength Evaluation (Compressed in a Direction Vertical to the Length of the Paper Tube)

Figure 10:
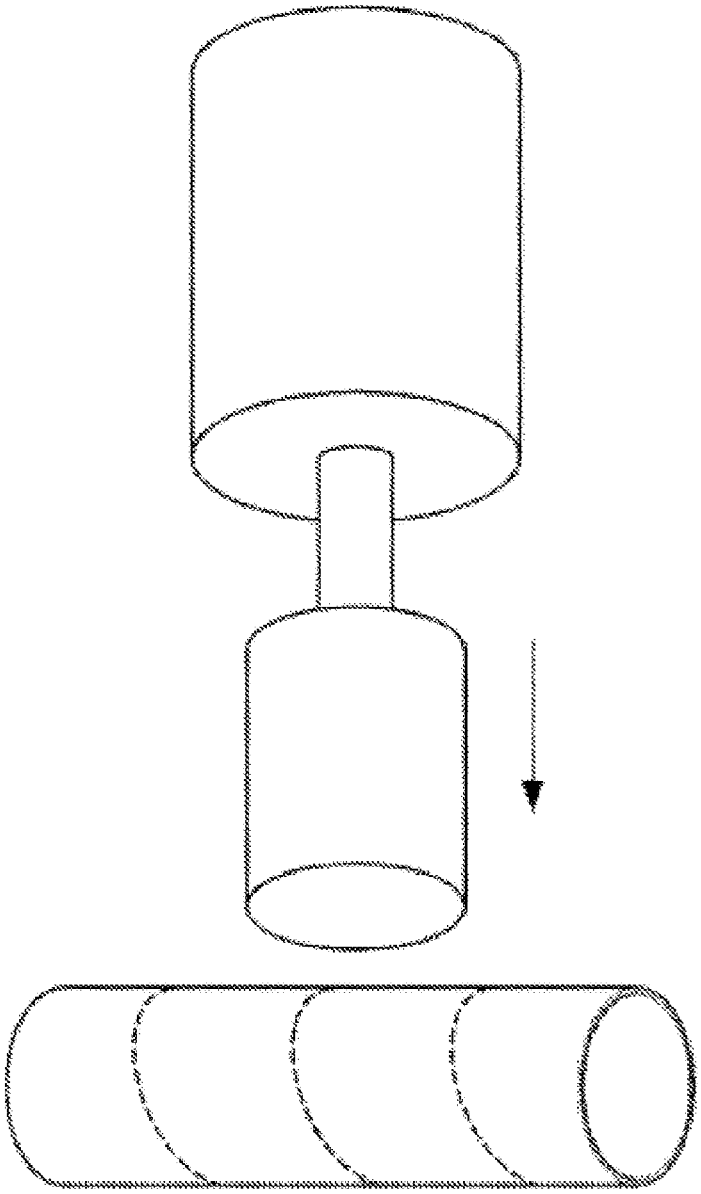
FIG. 10 is a diagram showing an example of the measurement process of a compression strength.

As shown in FIG. 10, the horizontally-laid paper tube was pressurized until it was compressed by 20 mm, and the load exerted on the paper tube at that moment was measured.

3. Degree of Split and Damage Evaluation

A degree of split and damage were observed with the naked eye. The comparative evaluation results of the paper tube of Examples 1 to 5 are shown in Table 1 and FIG. 11. In Table 1, "split time" refers to a time taken to completely tear off the paper tube.

TABLE 1

| | a:b | | | | |
|---|---|---|---|---|---|
| | Example 1 (0.5:1) | Example 2 (1:1) | Example 3 (2:1) | Example 4 (5:1) | Example 5 (10:1) |
| Split Strength (kgf) | 8.12 | 5.94 | 4.02 | 3.11 | 1.42 |
| Compressive Strength (kgf) | 9.02 | 6.99 | 5.78 | 3.78 | 2.12 |
| Split Time (in Seconds) | 2.7 | 2.1 | 1.7 | 1.2 | 0.8 |

Figure 11:
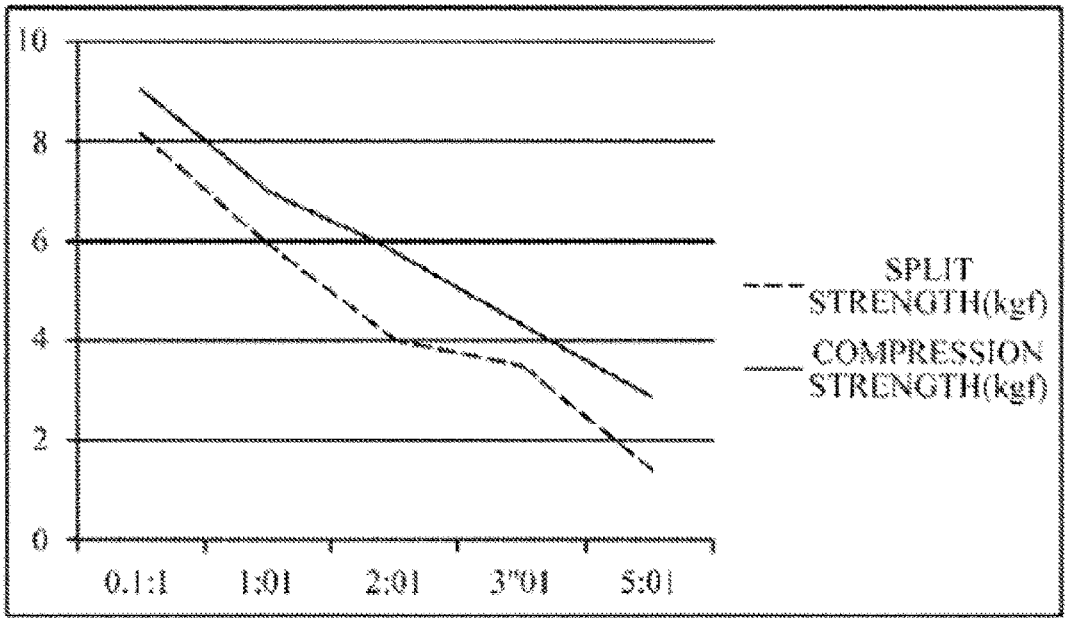
FIG. 11 is a graph showing a split strength and a compression strength according to a ratio of a perforation of a perforated portion to a non-perforated part between two perforations.

As indicated by Table 1 and FIG. 11, which is a graph showing a split strength and a compressive strength according to the length ratio of a perforation to a length between two perforations, the split strength for removing the paper tube and the compressive strength of the paper tube may vary according to the length ratio of a perforation and a length between two perforations. In this evaluation, with the increase in a ratio of perforations, the split strength was reduced, thereby facilitating the removal of the paper tube, while the compressive strength was also decreased, which caused the paper tube to be easily torn during the handling, and degraded the work efficiency in the process of winding material around the paper tube, due to a lower surface pressure. Therefore, it is appreciated that the ratio of a perforation to a non-perforated part between two perforations needs to be adjusted in accordance with the material to be wound and procedures, and it may be preferable that a ratio is set to 0.5:1 to 10:1.

Figure 12:
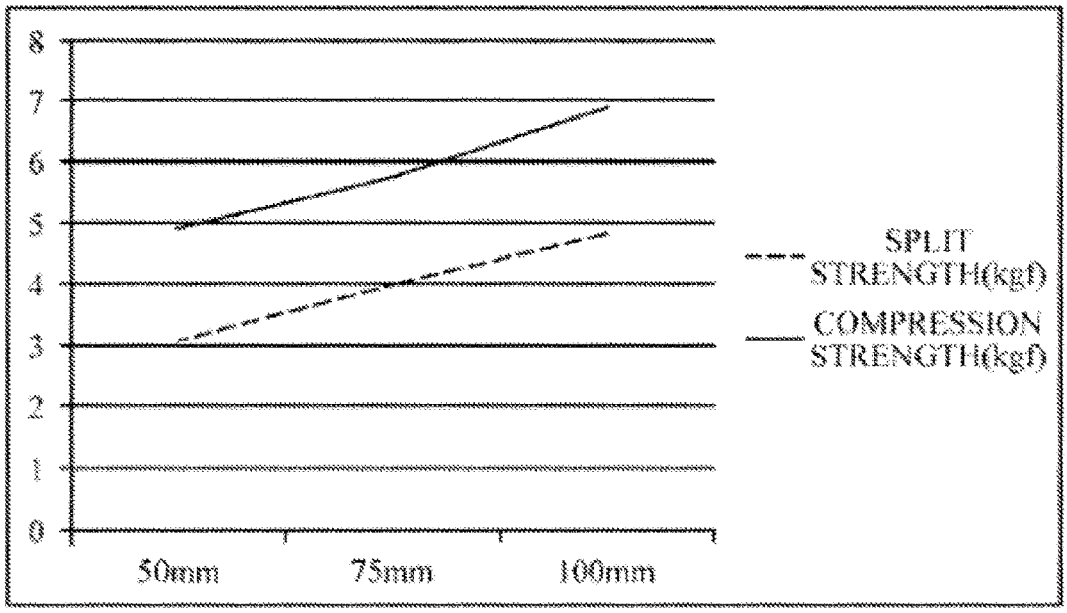
FIG. 12 is a graph showing a split strength and a compression strength according to a width of source paper.

The split strength and compressive strength evaluation results of the paper tubes with different source paper widths of Examples 6 to 8 are shown in Table 2 and FIG. 12.

TABLE 2

| | Width of Source Paper | | |
|---|---|---|---|
| | Example 6 (50 mm) | Example 7 (75 mm) | Example 8 (100 mm) |
| Split Strength (kgf) | 3.12 | 4.02 | 4.85 |
| Compressive Strength (kgf) | 4.95 | 5.78 | 6.93 |
| Split Time (in Seconds) | 2.9 | 1.7 | 1.1 |

As seen in Table 2 and FIG. 2 that is graph showing a split strength and a compressive strength of the paper tube according to a width of the source paper, the split strength and the compressive strength varied in accordance with a width of source paper. As the source paper has a wider width, the number of splits per predetermined length of the paper tube is decreased, so that the time taken to remove the paper tube is cut down, which enhances work efficiency but raises the split strength. Also, it is seen that as the source paper increases in width, the absolute amount of perforations is reduced, which results in the tendency to increase in a strength that compresses the paper tube.

Split strength and compressive strength evaluation results of the paper tube of Example 3 that was manufactured by perforating the primary source paper and the paper tube of Example 9 that was enhanced by the secondary source paper are shown in Table 3.

TABLE 3

| | Example 3 (Before Source Paper Enhancement) | Example 9 (After Source Paper Enhancement) |
|---|---|---|
| Split Strength (kgf) | 4.02 | 4.03 |
| Compressive Strength (kgf) | 5.78 | 7.24 |

When the remaining area of the paper tube, other than the perforations, was enhanced by the secondary source paper, the compressive strength of the paper tube was increased while the split strength was maintained substantially the same, as seen in Table 3. In this manner, work efficiency may be enhanced while lowering the split strength, and damage to the paper tube, which may occur during handling, may be significantly reduced while increasing the compressive strength. However, if the source paper used in enhancement is too thick or the enhancement is carried out using several sheets of source papers, it may result in a deterioration of work efficiency or handling due to a difference in thickness between a perforated portion and a non-perforated area. For example, the perforated portion may be easily split from the paper tube. Thus, the enhancement needs to be carried out with proper control of the source paper.

Table 4 shows evaluation results of the work efficiency (in removing the paper tube) and occurrence of internal damage to an article according to whether a performed surface of the paper tube of each of Examples 10 and Comparative Examples 1 to 3 has been processed with film and according to a length of the film.

TABLE 4

| | Comparative Example 1 (FIG. 7 (i)) | Example 10 (FIG. 7 (ii)) | Comparative Example 2 (FIG. 7 (iii)) | Comparative Example 3 (FIG. 7 (iv)) |
|---|---|---|---|---|
| Work Efficiency (Paper Tube Reduction) | OK | OK | NG | OK |
| Occurrence of Internal Damage | NG | OK | OK | NG |

As seen in Table 4, the work efficiency is not affected when the paper tube with film surrounded around its surface (outermost circumferential surface) is split, while the damage to the internal part of the material due to the torn part or damaged part of the paper tube can be noticeably prevented. In this case, the length of the film or paper surrounding the outermost circumferential surface of the paper tube is shorter than the entire length of the paper tube, but longer than the wound material (article), as provided in Example 10, so that the work efficiency at the time of tearing the perforated portion on a top part of the paper tube for the initial splitting is not affected, while the internal part of the article can be effectively protected due to the longer length of the film than that of the material.

As apparent from the above description, it is feasible to optimize the easily removable paper tube by adding necessary functions thereto through various embodiments. In addition, while the above exemplary embodiments are provided only as representative exemplary embodiments, it is obviously understood that the present invention is not limited thereto.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An easily removable paper tube comprising:

a perforated portion formed by helically perforating a winding surface of the paper tube with a cylindrical shape, wherein a winding surface of the paper tube further includes at least one additional sheet of source paper wrapped around an entire surface thereof, except the perforated portion.

2. The easily removable paper tube of claim 1, wherein a length ratio of a perforation of the perforated portion to a non-perforated part is 0.5:1 to 10:1.

3. The easily removable paper tube of claim 1, wherein an angle of the perforated portion relative to a horizontal plane is 20 degrees to 40 degrees.

4. The easily removable paper tube of claim 1, wherein a distance between two perforated portions is 30 mm to 200 mm.

5. The easily removable paper tube of claim 1, further comprising at least one sheet of film or paper that wraps around an outermost circumferential surface of the paper tube.

6. The easily removable paper tube of claim 5, wherein a central line surface roughness of the film or paper is 0.03 μm to 10 μm.

7. The easily removable paper tube of claim 5, wherein the film or paper is shorter than a length of the paper tube and longer than a length of material to be wound around the paper tube.

8. The easily removable paper tube of claim 5, wherein the film or the paper is thermally contracted.

9. The easily removable paper tube of claim 1, further comprising:

at least one sheet of film or paper that wraps around an outermost circumferential surface of the paper tube.

10. The easily removable paper tube of claim 9, wherein a central line surface roughness Ra of the film or paper is 0.03 μm to 10 μm.

11. The easily removable paper tube of claim 9, wherein the film or paper is shorter than a length of the paper tube and longer than a length of material to be wound around the paper tube.

12. The easily removable paper tube of claim 9, wherein the film or paper has thermally contracted.

13. An article using an easily removable paper tube of claim 1, the article comprising:

material wound around the paper tube.

14. The article of claim 13, wherein the material wound around the paper tube is one of fiber, non-woven fabric, a film, or fabric.

* * * * *